US006701618B2

(12) United States Patent
Gefen

(10) Patent No.: US 6,701,618 B2
(45) Date of Patent: Mar. 9, 2004

(54) TWO PIECE RING WITH FINGER GRIP GROOVE AND METHOD OF MANUFACTURE

(76) Inventor: Baruch Gefen, 12713 NW. 21st Pl., Coral Springs, FL (US) 33071

( * ) Notice: Subject to any disclaimer, the term of this patent is extended or adjusted under 35 U.S.C. 154(b) by 46 days.

(21) Appl. No.: 10/140,570

(22) Filed: May 7, 2002

(65) Prior Publication Data

US 2003/0209338 A1 Nov. 13, 2003

(51) Int. Cl.[7] ..... A44C 27/00
(52) U.S. Cl. ..... 29/896.412; 63/15
(58) Field of Search ..... 29/896.412, 896.4, 29/896.41, 507, 506; 63/15, 3, 7, 15.7, 15.8

(56) References Cited

U.S. PATENT DOCUMENTS 1,051,903 A * 2/1913 Mason ..... 29/896.411
1,442,240 A * 1/1923 Stone ..... 29/896.412
2,450,762 A * 10/1948 Marshall ..... 63/15.2
3,877,249 A * 4/1975 Sager ..... 63/15
5,718,278 A 2/1998 Baum
5,916,271 A 6/1999 Baum
5,979,537 A 11/1999 Baum
6,032,719 A 3/2000 Baum
6,116,053 A * 9/2000 Siebenberg ..... 63/15
6,123,141 A 9/2000 Baum

* cited by examiner

*Primary Examiner*—Gregory Vidovich
*Assistant Examiner*—Marc Jimenez
(74) *Attorney, Agent, or Firm*—Oltman, Flynn & Kubler

(57) ABSTRACT

A method of making a composite ring is provided, including the steps of manufacturing an outer ring portion having an inwardly opening outer ring portion concave recess; manufacturing an inner ring portion having an outwardly opening circumferential inner ring portion concave recess; fitting the inner ring portion inside the outer ring portion; and forcibly radially expanding the inner ring portion to fit into the outer ring portion concave recess. A composite ring is provided, including an outer ring portion having an inwardly opening outer ring concave recess; and an inner ring portion having an outwardly opening circumferential inner ring portion concave recess fitted inside the outer ring portion and forcibly radially expanded to fit into the outer ring portion concave recess. The inner ring portion inward surface preferably includes a circumferential skin gripping groove.

9 Claims, 2 Drawing Sheets

TWO PIECE RING WITH FINGER GRIP GROOVE AND METHOD OF MANUFACTURE

FILING HISTORY

The application is based at least in part upon the disclosure document number 499,241 filed on Aug. 30, 2001.

BACKGROUND OF THE INVENTION

1. Field of the Invention

The present invention relates generally to the field of jewelry manufacturing methods. More specifically the present invention relates to a method of making a composite ring made of either one or two metals. An outer ring portion having an inwardly opening concave recess is optionally formed of a more expensive metal, such as platinum, using well known ring forming technology. Then an inner ring portion having an outwardly opening circumferential concave recess is optionally formed of a less expensive metal, such as white gold. Alternatively, both the outer ring portion and the inner ring portion are made of the same metal, whether precious or not. Then inner ring portion is fitted inside outer ring portion and inner ring portion is forcibly expanded or radially stretched to fit into the concave recess of the outer ring portion, so that a composite ring is formed which has a virtually non-visible and a optionally a less expensive inward portion and optionally a more expensive and highly visible outward portion and an annular hollow interior defined by the opposing concave recesses and of the inner ring portion and the outer ring portion giving the ring a thick look and yet saving the cost of precious metal with the annular hollow interior.

The hollow interior of ring preferably extends part of the way, and alternatively all the way, around the ring circumference, so that the whole ring is hollow. The inner ring portion can be made either by stamping or by casting. The outer ring portion can be made by casting in a metal, rubber or silicone mold, or in a mold made of any other suitable material.

It is contemplated that the forming and interconnecting of two annular parts as described above may be used to form rings of precious or common metals, and may be used to form pendants and other types of jewelry. The inward ring surface of the resulting ring which rides against the user finger when worn can be either cross-sectionally rounded or cross-sectionally flat. The composite ring preferably narrows at bottom end as do most conventional rings for styling and comfort purposes, and no gripping groove segment need be provided in this narrowed segment of the ring circumference.

2. Description of the Prior Art

There have long been jewelry rings made of precious metal, some of which have been hollow to give an appearance of great cost with reduced actual expense. A problem with these prior rings has been that even with hollow construction, the amount of precious metal used in making the ring can lead to cost beyond what the wearer would like to pay. Another problem has been that the inward surface of the ring contacting the wearer skin can trap body heat and cause perspiration, making the skin slippery and making the ring more likely to slide off and be lost. Yet another problem has been that the broad contact area of a large ring with wear skin can cause irritation and even an allergic reaction.

It is thus an object of the present invention to provide a ring for wearing which is made of a highly visible outer ring portion having an inwardly opening channel and a separately stamped or cast, less visible inner ring portion having an outwardly opening channel, so that when the inner ring portion is expanded into and grips the outer ring portion a composite hollow ring is produced so that precious metal is conserved.

It is another object of the present invention to provide such a composite ring with a visible outer ring portion which can be made of more precious metal than the inner ring portion so that precious metal is still further conserved.

It is still another object of the present invention to provide such a ring which has a circumferential groove along its inward surface so that a smaller surface area of metal makes contact with the wearer skin, minimizing perspiration and resulting ring slippage while at the same time providing a skin gripping corrugation which also permits the wearer skin to breath and thus reduces irritation.

It is finally an object of the present invention to provide such a ring and method of ring manufacture which are inexpensive and reliable.

SUMMARY OF THE INVENTION

The present invention accomplishes the above-stated objectives, as well as others, as may be determined by a fair reading and interpretation of the entire specification.

A method of making a composite ring is provided, including the steps of manufacturing an outer ring portion having an inwardly opening outer ring portion concave recess; manufacturing an inner ring portion having an outwardly opening circumferential inner ring portion concave recess; fitting the inner ring portion inside the outer ring portion; and forcibly radially expanding the inner ring portion to fit into the outer ring portion concave recess; so that a composite ring is formed having a less visible inner ring portion and a more visible outer ring portion and an annular hollow interior defined by the opposing inner ring portion concave recess and outer ring portion concave recess.

The inner ring portion is optionally manufactured by stamping or by casting. The outer ring portion is optionally manufactured by stamping or by casting. The outer ring portion is preferably formed of precious metal, and the inner ring portion preferably is formed of common metal. The inner ring portion optionally includes an inward ring surface which is cross-sectionally rounded, alternatively which is cross-sectionally flat.

A composite ring is provided, including an outer ring portion having an inwardly opening outer ring concave recess; and an inner ring portion having an outwardly opening circumferential inner ring portion concave recess fitted inside the outer ring portion and forcibly radially expanded to fit into the outer ring portion concave recess; defining a composite ring having a less visible inner ring portion and a more visible outer ring portion and an annular hollow interior defined by the opposing inner ring portion concave recess and outer ring portion concave recess.

The outer ring portion preferably is formed of precious metal and the inner ring portion is formed of common metal. The inner ring portion optionally includes an inward ring surface which is cross-sectionally rounded, or is cross-sectionally flat.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
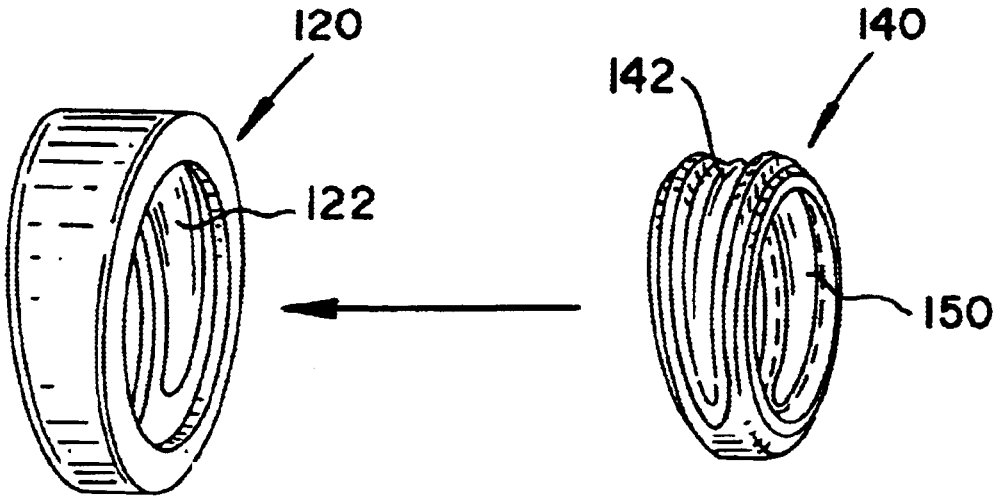
FIG. 1 is an exploded, perspective side view of the outer ring portion aligned with and ready to receive the inner ring portion during execution of the ring manufacturing steps.
Figure 2:
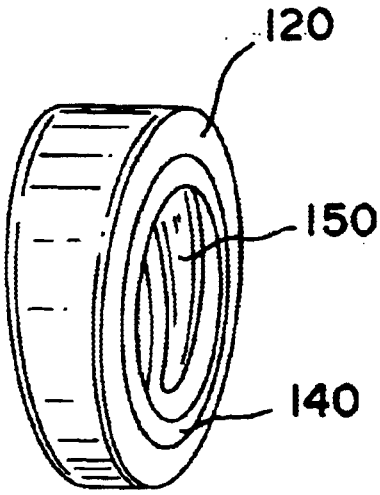
FIG. 2 is a perspective side view of the composite ring resulting from fitting and radially expanding the inner ring portion into the outer ring portion.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Method

Figure 5:
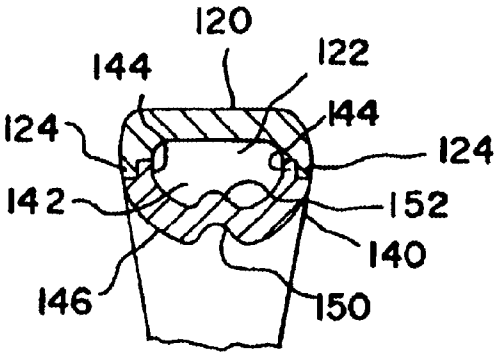
FIG. 5 is a partial cross-sectional side view of the assembled ring of FIG. 2, showing the interlocking side rails of the inner and outer ring portions fitted together.
Figure 4:
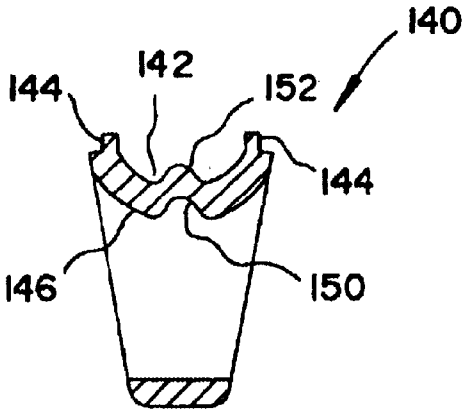
FIG. 4 is a cross-sectional side view of the ring of FIG. 3.
Figure 3:
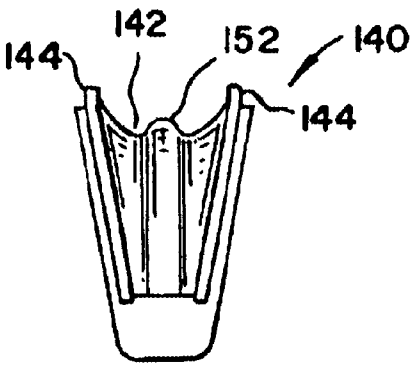
FIG. 3 is a side view of the inner ring portion showing the interlocking edge rails for meshing with outer ring portion edge rails, and shows the upward bulge typically, although not necessarily produced by the circumferential gripping groove along the inward surface of the inner ring portion.

Referring to FIGS. 1–5, a method of making a jewelry ring 100 such as a ring of either one or two metals is disclosed, including the steps of manufacturing an outer ring portion 120 having an inwardly opening concave recess 122, optionally of a more expensive metal, such as platinum, using well known ring forming technology, as shown in FIG. 1; manufacturing an inner ring portion 140 having an outwardly opening circumferential concave recess 142, optionally of a less expensive metal, such as white gold, again as shown in FIG. 1; and fitting inner ring portion 140 inside outer ring portion 120 and forcibly expanding or radially stretching inner ring portion 140 to fit into the concave recess 122 of the outer ring portion 120, so that a composite ring 100 is formed. The inner ring portion 140 has circumferential inner ring portion rails 144 which fit into interlocking relation with outer ring portion rails 124 following inner ring portion 120 expansion, as shown in FIGS. 4 and 5, to lock the inner ring portion 140 within the outer ring portion 120. Although circumferential, the inner ring portion rails 144 and outer ring portion rails 124 preferably extend only partly around the circumference of the ring, as to the ring concave recesses 122 and 142. A circumferential gripping groove 150 in the inner ring portion 140 inward surface 146 preferably extends into and at least partially around the circumference of the ring 100 to reduce skin contact with the wearer and to provide a skin breathing space. Both the outer ring portion 120 and the inner ring portion 140 can be made of the same metal, whether precious or not. Provision of gripping groove 150 may or may not produce a corresponding bulge 152 in the outwardly opening concave recess 142.

It is contemplated that the forming and interconnecting of two annular parts as described above may be used to form rings of precious or common metals.

First Preferred Embodiment

A composite ring 100 such as a ring is disclosed including an outer ring portion 120 having an inwardly opening concave recess 122, using well known ring forming technology, as shown in FIG. 1; and an inner ring portion 140 having an outwardly opening circumferential concave recess 142, again as shown in FIG. 1; fitted inside outer ring portion 120 and forcibly expanded or radially stretched to fit into the concave recess 122 of the outer ring portion 120. Ring 100 thus includes a virtually non-visible and a optionally a less expensive inward portion and optionally a more expensive and highly visible outward portion and an annular hollow interior defined by the opposing concave recesses 122 and 142 of the inner ring portion 140 and the outer ring portion 120 giving the ring 100 a thick look and yet saving the cost of precious metal with the annular hollow interior. See FIG. 5. The hollow interior of ring 100 extends part of the way, or alternatively all the way, around the ring 100 circumference, so that the whole ring 100 is hollow. The inner ring portion 140 can be made either by stamping or by casting. The outer ring portion 120 can be made by casting in a metal, rubber or silicone mold, or in a mold made of any other suitable material. The inward ring surface of the resulting ring 100 which rides against the user finger when worn is either cross-sectionally rounded or cross-sectionally flat.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of making a composite ring, comprising the steps of:

manufacturing an outer ring portion having an inwardly opening outer ring portion concave recess;

manufacturing an inner ring portion having an outwardly opening circumferential inner ring portion concave recess;

fitting said inner ring portion inside said outer ring portion;

and forcibly radially expanding said inner ring portion to fit into said outer ring portion concave recess;

such that a composite ring is formed having a less visible inner ring portion and a more visible outer ring portion and an annular hollow interior defined by the opposing said inner ring portion concave recess and outer ring portion concave recess.

2. The method of claim 1, wherein said inner ring portion is manufactured by stamping.

3. The method of claim 1, wherein said inner ring portion is manufactured by casting.

4. The method of claim 1, wherein said outer ring portion is manufactured by stamping.

5. The method of claim 1, wherein said outer ring portion is manufactured by casting.

6. The method of claim 1, wherein said inner ring portion is formed of precious metal.

7. The method of claim 1, wherein said outer ring portion is formed of common metal.

8. The method of claim 1, wherein said inner ring portion comprises an inward ring surface which is cross-sectionally rounded.

9. The method of claim 1, wherein said inner ring portion comprises an inward ring surface which is cross-sectionally flat.

* * * * *